US007269554B2

(12) United States Patent
Lopez-Estrada et al.

(10) Patent No.: US 7,269,554 B2
(45) **Date of Patent: *Sep. 11, 2007**

(54) METHOD, APPARATUS, AND SYSTEM FOR EFFICIENT RATE CONTROL IN AUDIO ENCODING

(75) Inventors: Alex A. Lopez-Estrada, Chandler, AZ (US); Mark P. VanDeusen, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 508 days.

This patent is subject to a terminal disclaimer.

(21) Appl. No.: 10/783,556

(22) Filed: Feb. 19, 2004

(65) Prior Publication Data

US 2004/0162723 A1 Aug. 19, 2004

Related U.S. Application Data

(63) Continuation of application No. 09/967,440, filed on Sep. 27, 2001, now Pat. No. 6,732,071.

(51) Int. Cl.
*G10L 19/02* (2006.01)

(52) U.S. Cl. ..... 704/229; 704/230; 704/225; 704/219; 704/200.1

(58) Field of Classification Search ..... 704/200.1, 704/219, 222, 225, 229, 230, 210
See application file for complete search history.

(56) References Cited

U.S. PATENT DOCUMENTS 4,815,134 A 3/1989 Picone
5,226,084 A 7/1993 Hardwick et al.
5,481,614 A 1/1996 Johnston
5,590,108 A * 12/1996 Mitsuno et al. ..... 704/229
5,627,938 A * 5/1997 Johnston ..... 704/200.1
5,664,057 A 9/1997 Crossman
5,682,463 A * 10/1997 Allen et al. ..... 704/230
5,978,762 A * 11/1999 Smyth et al. ..... 704/229
6,363,338 B1 3/2002 Ublae
6,510,407 B1 1/2003 Wang

OTHER PUBLICATIONS

Starer et al. "Polynomial Factorization Algorithms for Adaptive Root Estimation," Acoustics, Speech, and Signal Processing, 1989. ICASSP-89, 1989 International Conference on 23-26, pp. 1158-1161, vol. 2.

Berberidis, K. and Theodoridis, S. "An Efficient Block Newton-Type Algorithm." Acoustics, Speech, and Signal Processing, 1995., 1995 International Conference on, vol. 2, May 9-12, 1995, pp. 1133-1136, vol. 2.

* cited by examiner

*Primary Examiner*—Vijay Chawan
(74) *Attorney, Agent, or Firm*—Blakely, Sokoloff, Taylor & Zafman LLP

(57) ABSTRACT

According to one aspect of the invention, a method is provided in which audio samples representing an input audio signal are received. The input audio samples are transformed into a vector of spectral values in a frequency domain. A value of a quantizing parameter is determined that satisfies one or more criteria based, at least in part, on a modified Newtonian search process, the determined value of the quantizing parameter being used to quantize the respective vector of spectral values to generate a vector of quantized values.

23 Claims, 7 Drawing Sheets

METHOD, APPARATUS, AND SYSTEM FOR EFFICIENT RATE CONTROL IN AUDIO ENCODING

This application is a Continuation of application Ser. No. 09/967,440 filed Sep. 27, 2001 now U.S. Pat. No. 6,732,071.

FIELD OF THE INVENTION

The present invention relates to the field of signal processing. More specifically, the present invention relates to a method, apparatus, and system for efficient rate control in audio encoding.

BACKGROUND OF THE INVENTION

As technology continues to advance and the demand for video and audio signal processing continues to increase at a rapid rate, effective and efficient techniques for signal processing and data transmission have become more and more important in system design and implementation. Various standards or specifications for audio signal processing have been developed over the years to standardize and facilitate various coding schemes relating to audio signal processing. In particular, a group known as the Moving Pictures Expert Group (MPEG) was established to develop a standard or specification for the coded representation of moving pictures and associated audio stored on digital storage media. As a result, a standard known as the ISO/IEC 11172-3 (Part 3—Audio) CODING OF MOVING PICTURES AND ASSOCIATED AUDIO FOR DIGITAL STORAGE MEDIA AT UP TO ABOUT 1.5 MBITS/S (also referred to as the MPEG standard or MPEG specification herein), published August, 1993, was developed which standardizes various coding schemes for audio signals, e.g., MPEG-1 or MPEG-2 Layers I, II, and III. ISO stands for International Organization for Standardization and IEC stands for International Electrotechnical Commission, respectively. Generally, the MPEG audio specification does not standardize the encoder but rather the type of information that an encoder needs to produce and write to an MPEG compliant bitstream, as well as the way in which the decoder needs to parse, decompress, and resynthesize this information to regain the encoded audio signals. In particular, MPEG standard is developed for perceptual audio coding rather than lossless coding. In lossless coding, redundancy in the waveform is reduced to compress the sound signal and the decoded sound wave does not differ from the original sound wave. In contrast, in perceptual audio coding, the aim is not to regain the original signal exactly after encoding and decoding but rather to eliminate those parts of the audio signal that are irrelevant to the human ear (e.g., that are not heard).

An audio encoder typically includes a bit allocation module or unit (also called the bit allocator herein) whose role is to allocate more bits to those frequencies where quantization noise is audible to a listener and allocate fewer bits to those frequencies where quantization noise is masked and is inaudible to the listener. Also, the bit allocator needs to ensure that the total number of bits used for a specific audio block or frame does not exceed the maximum number of bits available as determined by the specified output bit rate. Currently, the methods for performing the bit allocation, as described in the MPEG standard includes two processing loops: (1) an outer or distortion control loop; and (2) an inner or rate control loop. One of the problems or disadvantages associated with the current methods described in the ISO/IEC 11272-3 MPEG standard is their inefficiency due to numerous iterations involved in determining or computing the optimum quantization parameters that will satisfy the rate criteria.

BRIEF DESCRIPTION OF THE DRAWINGS

The features of the present invention will be more fully understood by reference to the accompanying drawings, in which.

DETAILED DESCRIPTION

In the following detailed description numerous specific details are set forth in order to provide a thorough understanding of the present invention. However, it will be appreciated by one skilled in the art that the present invention may be understood and practiced without these specific details. Furthermore, while the teachings of the present invention are applicable to MPEG Layer III (commonly known as MP3) audio encoding, it should be appreciated and understood by one skilled in the art that the present invention is not limited to MPEG Layer III audio encoding and can be applied to any method, apparatus, and system for efficient bit allocation to accomplish bit rate reduction in audio processing.

Figure 1:
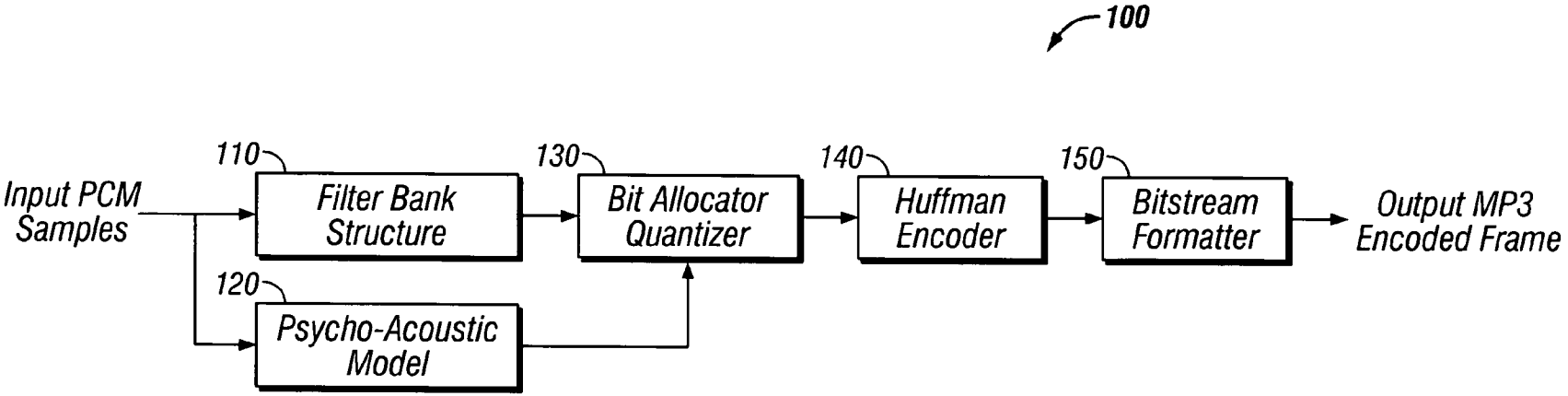
FIG. 1 is a block diagram of one embodiment of an encoder in which the teachings of the present invention may be implemented.

FIG. 1 is a block diagram of one embodiment of an encoder 100 in which the teachings of the present invention may be implemented. In one embodiment, the audio encoder 100 may include a filter bank structure or unit 110, a psycho-acoustic model (PAM) 120, a bit allocator and quantizer 130, a Huffman encoder 140, and a bitstream formatter 150. In one embodiment, input audio samples such as pulse code modulation (PCM) samples are fed into the filter bank unit 110 and transformed using a filter bank to generate output sub-band samples. In MP3 audio encoding, the output sub-band samples can be further processed using a Modified Discrete Cosine Transform (MDCT) to obtain higher frequency resolution. The input PCM samples are also input to the Psycho-Acoustic model 120, which independently analyzes the input data and models human auditory perception. The psycho-acoustic model 120 is designed and configured to determine the ear sensitivity to noise in the frequency domain. In one embodiment, the output from the psycho-acoustic model 120 is a frequency mask that describes the maximum allowed quantization noise in each of the bands. Both the MDCT output spectrum and the frequency mask are then input into the bit allocator and quantizer 130. The function of the bit allocator (also called bit allocation module herein) in block 130 is to allocate more bits to those frequencies where quantization noise is audible to the listener and allocate fewer bits to frequencies where quantization noise is masked by program material and is inaudible to the listener. Furthermore, the bit allocator needs to ensure that the total number of bits used for a specific PCM block (or frame) does not exceed the maximum number of bits available as determined by the specified output bit rate. The output generated from the bit allocator and quantizer 130 is then input into the Huffman encoder 140. The bitstream formatter 150 is configured to generate output encoded audio frames based on the data received from the Huffman encoder 140.

Figure 2:
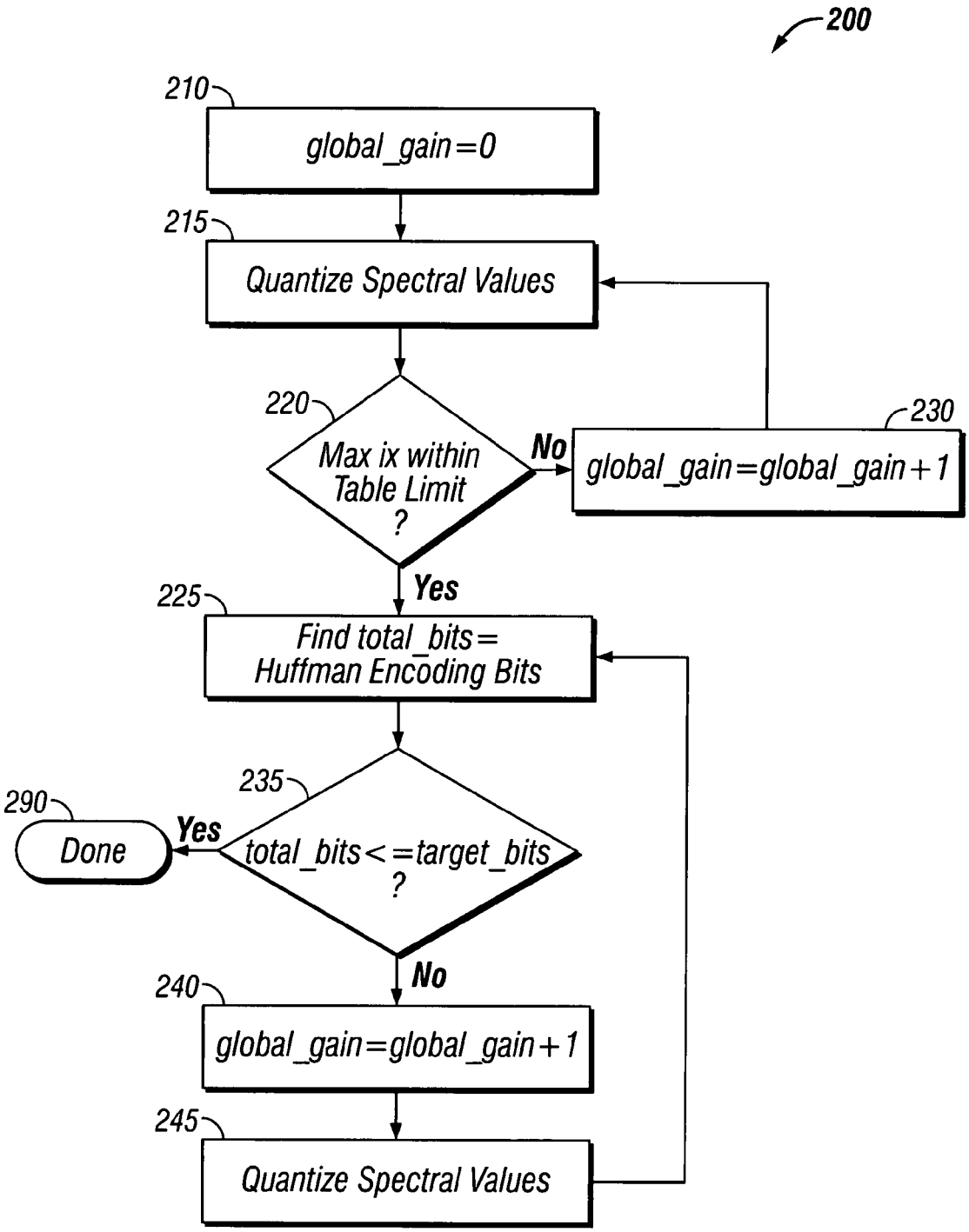
FIG. 2 is a flow diagram illustrating an inner or rate control loop of a bit allocation method according to the current ISO/IEC specification.

FIG. 2 is a flow diagram illustrating an inner or rate control loop of a bit allocation method according to the current ISO/IEC specification. Generally, the rate control loop is responsible for selecting a global_gain value (also called the quantizer step size value herein) to insert in the following quantization formula:

$$ix(i) = nint\left[\left(\frac{|x_r(i)|}{2^{\frac{\text{global_gain}}{4}}}\right)^{3/4} + 0.0946\right] \quad (1)$$

where ix corresponds to the quantized spectral values for frequency line i, and xr corresponds to the original spectral value. Since the quantized values will be further encoded using Huffman tables, the global_gain parameter first is adjusted so that the maximum quantized value falls below the maximum limit of the corresponding Huffman look-up tables described in ISO/IEC specification. This is done according to the ISO/IEC spec by continuously increasing the global_gain value until the maximum quantized value is less or equal to the maximum Huffman lookup table (LUT) index (e.g. 8191 for MP3 encoding). After selecting the minimum global_gain to allow Huffman table look-up, the next task is to ensure that the number of bits used for Huffman encoding does not exceed the maximum number of bits allocated for the block of spectral values. This is done according to the ISO/IEC spec by continuously increasing the global_gain value until the number of bits used for encoding is equal or less than the maximum number of bits allocated for the block. As shown in FIG. 2, at block 210, the global_gain value is initially set to zero or to some initial estimate. At block 215, the spectral values are quantized. At decision block 220, if the maximum quantized spectral value is within the corresponding Huffman table limit, then the process continues to block 225, otherwise the process proceeds to block 230. At block 230, the value of the global_gain is increased (e.g., incremented by 1) and the process loops back to block 215. At block 225, a number of bits used for Huffman encoding is determined. At decision block 235, if the number of bits used for Huffman encoding exceeds the maximum number of bits allocated for the block of spectral values, then the process proceeds to block 240 to increase the value of the global_gain (e.g., increment the value of the global_gain by 1), otherwise the process proceeds to end at block 290. At block 245, the spectral values are quantized. The process then loops back from block 245 to block 225.

Figure 3:
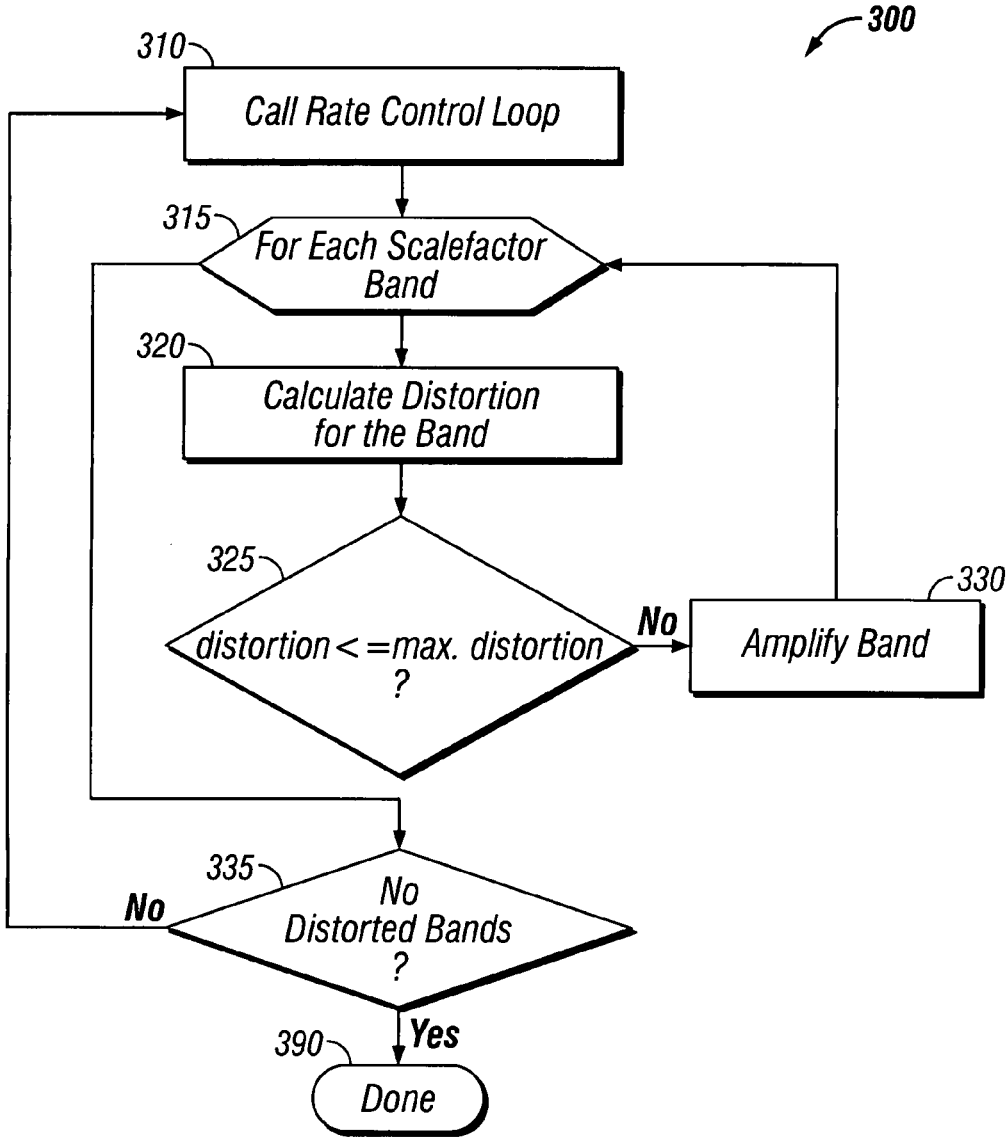
FIG. 3 shows a flow diagram illustrating an outer or distortion control loop of a bit allocation method according to the current ISO/IEC specification.

FIG. 3 shows a flow diagram illustrating an outer or distortion control loop of a bit allocation method according to the current ISO/IEC specification. Generally, after determining a global_gain value to meet the rate criteria as described above, the outer or distortion control loop computes the amount of distortion introduced by the quantization. This is accomplished by decoding the quantized value and finding the mean-squared error (MSE), or some other distortion measure, between the decoded spectral value and the original spectral value within each scalefactor band (group of frequency lines). Scalefactor bands not meeting the distortion criteria are amplified by some prescribed factor and the rate control loop is called iteratively with the new amplified spectral values, until the distortion criteria is met for all the bands. As shown in FIG. 3, at block 310 the rate control loop as described in FIG. 2 is called to determine a global_gain value. At block 315, for each scalefactor band, the process proceeds as follows. At block 320, the distortion for the respective band is calculated. At decision block 325, if the distortion calculated does not meet the distortion criteria (e.g., the distortion calculated is not less than the maximum distortion allowed) then the process proceeds to block 330 to amplify the respective band by a predetermined factor. At decision block 335, if the distortion criteria is met for all the bands (e.g., no distorted bands), then the process proceeds to end at block 390. Otherwise the process loops back to block 310.

As mentioned above, a disadvantage associated with the methods disclosed in the ISO/IEC document is their inefficiency due to the numerous iterations involved in computing the global_gain value to satisfy the rate criteria. As described in more details below, according to the teachings of the present invention, a new method is provided for efficient bit allocation of spectral values obtained from a sub-band filter. In one embodiment of the present invention, the method as described herein is directed to improving the efficiency of the rate control loop (also called rate control process herein). The method as described herein includes the following:

- Deriving a closed form equation to determine the global_gain to meet the maximum Huffman look-up limit; and
- Using a modified Newtonian search to determine the global_gain required to meet the rate criteria.

Accordingly, at a high level, the present invention includes two parts or two components as follows: (1) efficient determination of a minimum global_gain value to meet the maximum Huffman look-up criteria; and (2) efficient determination of a global_gain value to meet the rate criteria within the rate control loop.

Determining the Minimum Global Gain Value to Meet the Maximum Huffman Look-up Criteria Huffman tables that are used in a typical audio encoder are limited to a maximum quantized value that can be looked up using the table index. For example, Huffman tables that are used in a typical MP3 encoder are limited to a maximum quantized value of 8191 that corresponds to 13 bits of precision ($2^{13}$ entries). Therefore, the maximum quantized value for the block of spectral values needs to be bounded to the maximum index into the corresponding Huffman tables. For illustration and generalization purposes, the maximum quantized value is called $\alpha$. In the case of MP3 encoding, $\alpha$=8191. Equation (2) below can be obtained using equation (1) shown above:

$$ix(i) = nint\left[\left(\frac{|x_r(i)|}{2^{\frac{\text{global_gain}}{4}}}\right)^{3/4} + 0.0946\right] \leq \alpha \quad (2)$$

Removing the nint[] function (standing for nearest integer), the following equation (3) can be obtained:

$$\left(\frac{|x_r(i)|}{2^{\frac{\text{global_gain}}{4}}}\right)^{3/4} + 0.0946 + \varepsilon \le \alpha \tag{3}$$

where $\epsilon$ is the error introduced by quantizing to the nearest integer, and therefore:

$$|\epsilon| \leqq 0.5 \tag{4}$$

In one embodiment, using =0.5 and setting $|x_r(i)|=\text{MAX}|x_r(i)|$ will result in the largest value for the left hand side of equation (3), where $\text{MAX}|x_r(i)|$ represents the largest spectral value magnitude across the frequency lines indexed by i. Therefore, equation (3) can be re-written as:

$$\left(\frac{\text{MAX}|x_r(i)|}{2^{\frac{\text{global_gain}}{4}}}\right)^{3/4} + 0.0946 + 0.5 \le \alpha \tag{5}$$

The following equations (6)-(10) are used to solve equation (5) for the variable global_gain. Equation (5) can be rewritten as follows:

$$\left(\frac{\text{MAX}|x_r(i)|}{2^{\frac{\text{global_gain}}{4}}}\right)^{3/4} \le \alpha - 0.5946 \tag{6}$$

Taking the ⅘ root on both sides of equation (6), equations (7) is obtained as shown below:

$$\frac{\text{MAX}|x_r(i)|}{2^{\frac{\text{global_gain}}{4}}} \le [\alpha - 0.5946]^{4/3} \tag{7}$$

Solving for $2^{global_gain/4}$ results in the following equation:

$$2^{\frac{\text{global_gain}}{4}} \ge \frac{\text{MAX}|x_r(i)|}{[\alpha - 0.5946]^{4/3}} \tag{8}$$

Taking the logarithm base 2 of both sides of equation (7), the following equation is obtained:

$$\frac{\text{global_gain}}{4} \ge \log_2\left(\frac{\text{MAX}|x_r(i)|}{[\alpha - 0.5946]^{4/3}}\right) \tag{9}$$

Solving for global_gain results in equation (10) shown below:

$$\text{global_gain} \ge 4 \cdot \log_2\left(\frac{\text{MAX}|x_r(i)|}{[\alpha - 0.5946]^{4/3}}\right) \tag{10}$$

Since global_gain needs to be an integer number, take the ceiling of equation (10) to obtain the following equation:

$$\text{global_gain} \ge \left\lceil 4 \cdot \log_2\left(\frac{\text{MAX}|x_r(i)|}{[\alpha - 0.5946]^{4/3}}\right)\right\rceil \tag{11}$$

where $\lceil x \rceil$ corresponds to the nearest integer that is greater than or equal to x. Therefore, the minimum global_gain value required to meet the maximum Huffman table entry $\alpha$, can be computed from equation (11).

Efficient Determination of a Global Gain Value to Meet the Rate Criteria

In one embodiment of the present invention, a modified Newtonian search process or algorithm is developed as described in more details below to find the roots of the following equation:

$$\text{total_bits} = f_{Huffman}(ix) = f_{Huffman}(\text{global_gain}) \leqq \text{target_bits} \tag{12}$$

where $f_{Huffman}(.)$ corresponds to the total number of bits used during Huffman encoding of the quantized values ix, which as shown in equation (12) is a function of global_gain. The value target_bits correspond the maximum number of bits to be encoded per audio frame. In one embodiment, this value is dependent on a desired compression ratio or output bit rate and the input audio frame. For example, in MP3 encoding, the input audio frames include 1152 PCM samples per channel. If the input sampling rate of the audio signal is 44.1 KHz (or 44100 samples/sec), and the encoding is to be done at 128 Kbits/sec, then the target_bits for one channel of an audio frame can be computed as follows:

$$\text{target_bits} = \frac{128000 \text{ bits/sec} \cdot 1152 \text{ samples}}{441100 \text{ samples/sec}} - \langle \textit{bits used} \text{ for MP3 header} \rangle$$

In general, a Newtonian search process works by calculating the line tangent to an "unknown" surface and using the intercept of this line as a new guess for the root of the surface or function.

Figure 4:
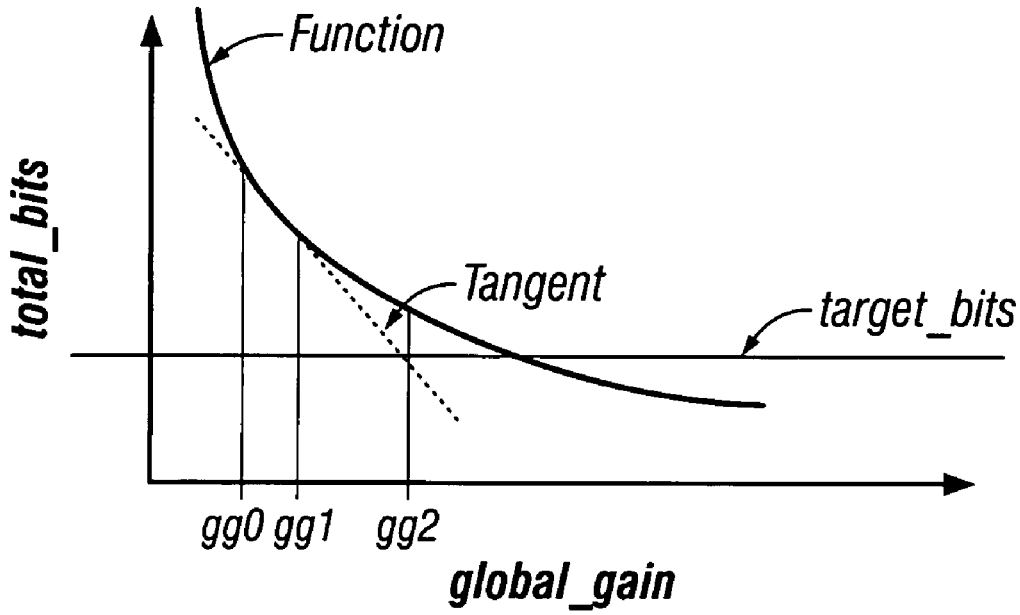
FIGS. 4, 5, and 6 illustrate examples of the progression from an initial global gain value to a final global gain value, in accordance with one embodiment of the present invention.
Figure 5:
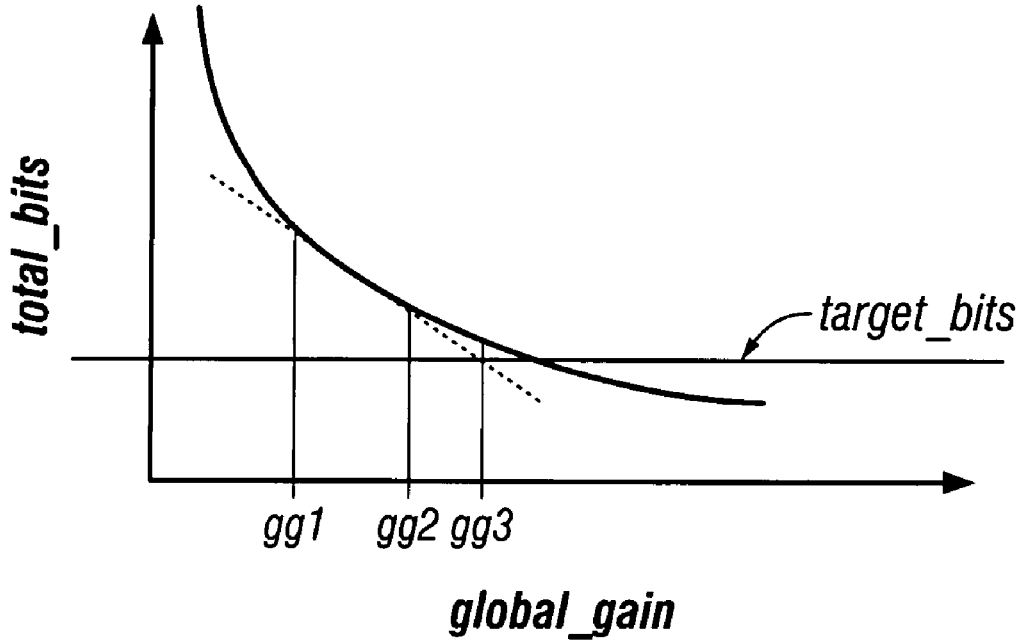
Figure 6:
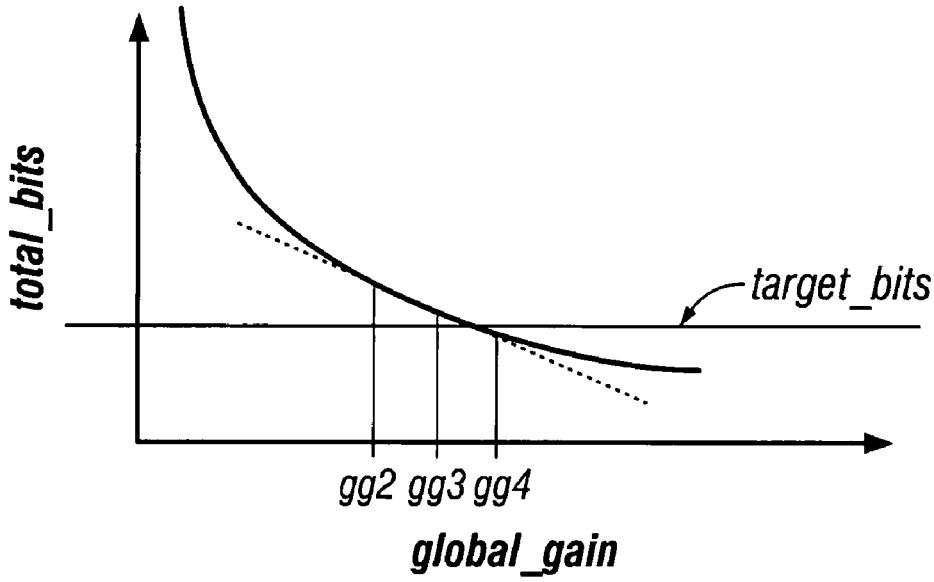

FIGS. 4, 5, and 6 illustrate examples of a progression from an initial global_gain value, gg0, towards a final global_gain, gg4, that satisfies the condition in equation (12), according to the teachings of the present invention. In one embodiment, linear convergence faster than the ISO/IEC method or ISO/IEC algorithm is achieved by using the x intercept to determine a new global_gain, which yields a bit allocation value closer to target_bits.

Generally, the Newton search algorithm or process is a special case of a class of root finding techniques based on Nth-order polynomials. Specifically, the Newton search corresponds to a $1^{st}$ order polynomial. This root finding technique derives from the Taylor Series of a function f(x) at some $\delta$ interval from x as follows:

$$f(x+\delta) = f(x) + f'(x)\delta + f''(x)\frac{\delta^2}{2} + \ldots + f^n(x)\frac{\delta^n}{n!} + \cdots \tag{13}$$

where $f^n(x)$ corresponds to the $n^{th}$ derivative of function f(x).

For relatively smooth functions, derivatives of $2^{nd}$ order and above may be negligible, and therefore, f(x+δ) may be approximated by:

$$f(x+\delta) \approx f(x)+f'(x)\delta \tag{14}$$

In trying to find the value of x for which the function is equal to some value c, set f(x+δ)=c, and obtain the following:

$$\delta \approx \frac{c-f(x)}{f'(x)} \tag{15}$$

Equation (15) corresponds to the Newton approximation. For the bit allocation problem as described herein, x is substituted with the global_gain; f(x) is substituted with the total Huffman bits, $f_{Huffman}$(global_gain); c is the desired root, in this case target_bits; and δ corresponds to the step size to be used to obtain a new global_gain. For clarity purposes, the f(global_gain) is used to represent $f_{Huffman}$ (global_gain) from now on. Therefore, equation (15) becomes:

$$\delta_{\text{global_gain}} \approx \frac{\text{target_bits}-f(\text{global_gain})}{f'(\text{global_gain})} \tag{16}$$

The derivative, f'(global_gain), at iteration i, can be numerically approximated as follows:

$$f'(\text{global_gain}_i) \approx \frac{f(\text{global_gain}_i)-f(\text{global_gain}_{i-1})}{\text{global_gain}_i-\text{global_gain}_{i-1}} \tag{17}$$

The estimation of the function's derivative uses the previously computed global_gain. This estimation of the derivative is sometimes called in literature as the Secant method for finding roots. Generally, this technique is simple and works well with well-behaved functions as in the case of Huffman tables. However, it should be understood and appreciated by one skilled in the art that any derivative estimation technique can be used in accordance with the teachings of the present invention.

In one embodiment, the assumption in the use of a $1^{st}$ order polynomial is that the function to be searched is relatively smooth and its derivative is close to a straight line. For example, the Huffman tables used for MPEG encoding are designed so that the total number of bits decreases progressively towards 0 as the global_gain is increased. Therefore, this implies that the function f(global_gain) is well behaved, and a $1^{st}$ order polynomial will suffice. In one embodiment, the straight line for the derivative is then used to estimate a new global_gain, i.e., $\text{global_gain}_{n+1}$.

Figure 7:
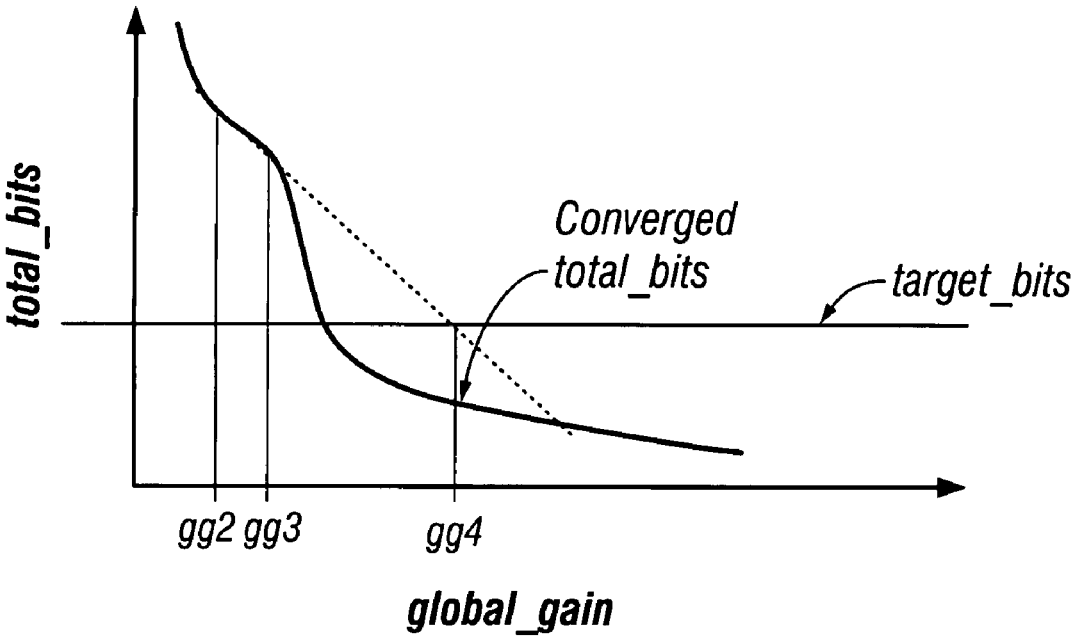
FIG. 7 shows an example of a curve where the estimation of the global_gain leads to a value of the total_bits that is below but not close to the target_bits.

Two issues may arise when using a Newtonian search with equation (12):

First, a large step size in the global_gain value will cause the algorithm to converge rapidly. However, the global_gain estimation should be as close as possible to the target_bits. FIG. 7 shows an example of a curve where the estimation of the global_gain leads to a value of the total_bits that is below the target_bits. However, this is not the closer one to the target bits, and hence, it is non-optimal.

Second, since global_gain needs to be an integer value, the global_gain value gets truncated to the closer integer that is less than or equal to the obtained global_gain during each iteration. As the search progresses in the iterations and gets closer to target_bits, the step size for estimating the new global_gain may be less than 1, which means that global_gain will not change and therefore the process would enter a non-convergent cycle.

In one embodiment of the present invention, the first issue was addressed by allowing the search process to back-track to a smaller value of global_gain after it reaches a global_gain that satisfies the condition in equation (12). In one embodiment, this back-tracking can be repeated more than once. Then, the global_gain that results in a total_bits closer to target_bits is selected. Usually, the selection may not be necessary, since the last global_gain after N times is the closer one to the target_bits. The times the process is allowed to reach a total_bits that satisfies equation (12) is denominated as "go_up" in the flow diagram shown in FIG. 8 described below.

In one embodiment, the second issue was addressed by forcing the global_gain during each iteration to be updated by at least a positive integer (e.g., +1) or a negative integer (e.g., −1), depending on the direction of the search. A positive integer such as +1 is used if the process is still progressing down towards target_bits, and a negative integer such as −1 is used when the process reaches a total_bits below target_bits and the search is continued.

In one embodiment of the present invention, the global_gain parameter is stored in memory to be used as an initial estimate for the next block of spectral values. Two initial values of total_bits ($tb_0$ and $tb_1$) computed from two initial global_gains ($gg_0$ and $gg_1$ respectively) are used to start the iteration. In one embodiment, $gg_0$ is taken as the global_gain pre-computed as described above and $gg_1$ can be computed as follows:

$$gg_1=\max(gg_0+\beta,\text{global_gain from previous block}) \tag{18}$$

where β can be a predetermined positive integer that can be optimized to increase the convergence rate. For example, a value of 5 for β can be used. In one embodiment, the global_gain of the previous block is compared with $gg_0$ to ensure that the criteria of equation (11) is met for $gg_1$.

Figure 8:
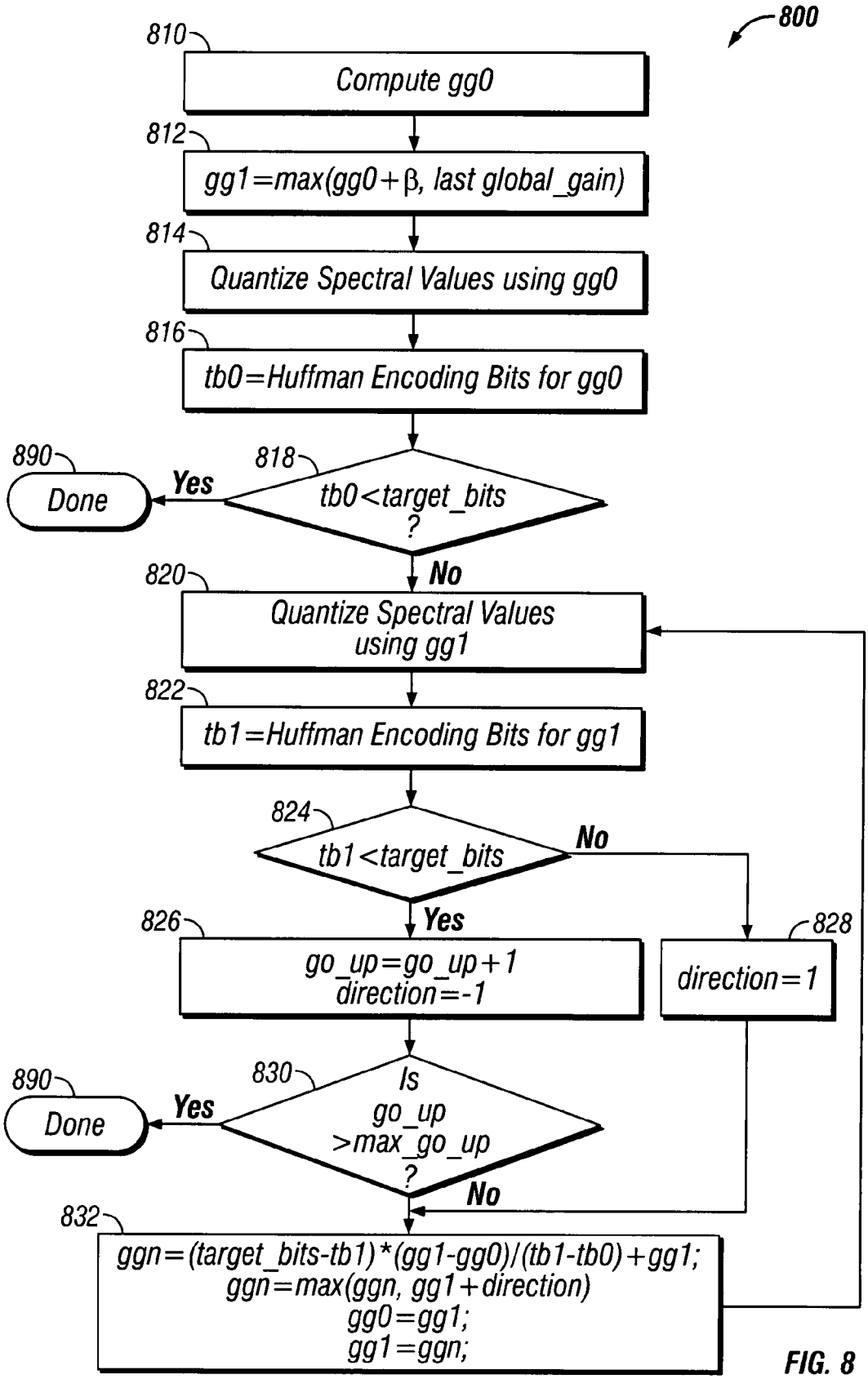
FIG. 8 shows a flow diagram of one embodiment of a rate control process according to the teaching of the present invention.

FIG. 8 shows a flow diagram of one embodiment of a rate control process (also called rate control loop) 800 according to the teaching of the present invention. At block 810, a first initial value of the global_gain parameter (e.g., gg0) is computed. In one embodiment, the first initial value gg0 is computed using equation (11) as described above. At block 812, a second initial value of the global_gain parameter (e.g., gg1) is computed, based on equation (18) as described above. At block 814, the spectral values are quantized using gg0. At block 816, a first initial value for the total_bits parameter is computed. In one embodiment, the first initial value for the total_bits is computed based on the Huffman encoding bits for gg0. At decision block 818, if the first initial value of the total_bits tb0 is below the target_bits value then the process proceeds to end at block 890. Otherwise, the process proceeds to block 820 to quantize the spectral values using $gg_1$. At block 822, a second initial value of the total_bits is computed. In one embodiment, the second initial value of the total_bits is computed using the Huffman encoding bits for gg1. At decision block 824, if the second initial value of the total_bits is below the target_bits value then the process proceeds to block 826, otherwise the process proceeds to block 828. At block 826, increase the number of iterations go_up (e.g., increment go_up by 1) and set the direction to back track to a smaller value of global_ gain (e.g., direction=−1). At block 828, since the current value of the total_bits is not below the target_bits value, set the direction to progress down towards the target_bits (e.g., direction=1). The process then proceeds either from block 826 to block 830 or from block 828 to block 832. At block 830, if the maximum number iterations is reached (e.g., go_up>max_go_up), then the process proceeds to end at block 890, otherwise the process proceeds to block 832. At block 832, two new initial values of the global_gain parameter are computed for another iteration, based on the previous values of the global_gain, the previous values of the total_bits, and the target_bits value. The process then loops back from block 832 to block 820 to continue the search for the desired global_gain value.

Figure 9:
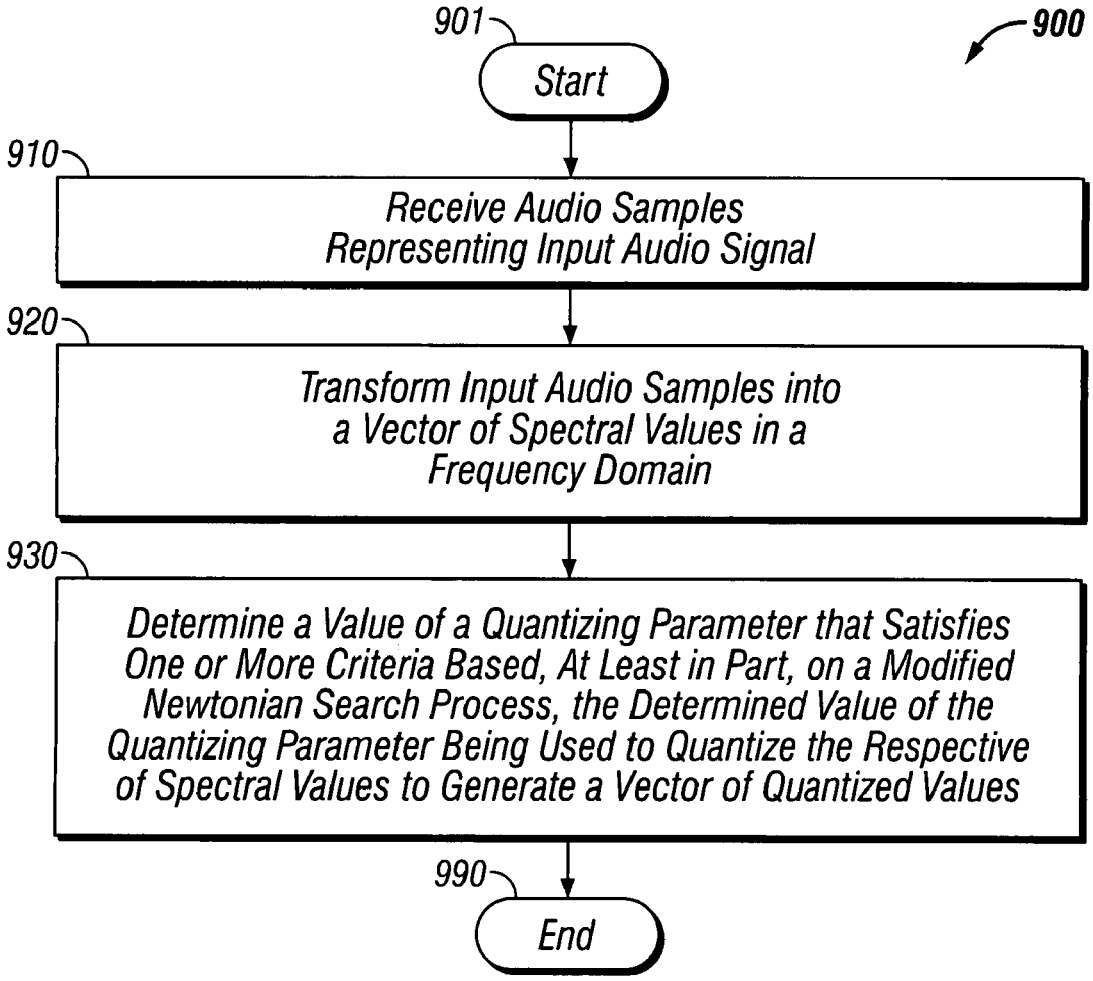
FIG. 9 shows a flow diagram of a process in accordance with one embodiment of the present invention.

FIG. 9 shows a flow diagram of a process in accordance with one embodiment of the present invention. At block 910, audio samples (e.g., PCM samples) representing an input audio signal are received. At block 920, the input audio samples are transformed into a vector of spectral values in a frequency domain. At block 930, a value of a quantizing parameter that satisfies one or more criteria is determined, based at least in part, on a modified Newtonian search process. The determined value of the quantizing parameter is used to quantize the respective vector of spectral values to generate a vector of quantize values.

As described above, several other root finding techniques can also be used in place of the Newtonian search. The theory behind some of the various techniques is discussed below.

Higher Order Polynomials

Higher order polynomials may be used to estimate the root of the function. For an Nth order polynomial, equation (13) is truncated after the Nth derivative. For example, a $2^{nd}$ order polynomial will correspond to:

$$f(x+\delta) = f(x) + f'(x)\delta + f''(x)\frac{\delta^2}{2} \tag{19}$$

In order to obtain the value of δ that will satisfy the root condition, the following quadratic equation needs to be solved:

$$c = f(x) + f'(x)\delta + f''(x)\frac{\delta^2}{2} \tag{20}$$

Also, it is required to estimate the $2^{nd}$ derivative of the function f(x). If equation (17) is used to estimate the $2^{nd}$ derivative, the following is obtained:

$$f''(\text{global_gain}_i) \approx \frac{f'(\text{global_gain}_i) - f'(\text{global_gain}_{i-1})}{\text{global_gain}_i - \text{global_gain}_{i-1}} \tag{21}$$

which requires storing of the derivative at iteration i−1.

The technique of using a $2^{nd}$ order polynomial, and using equation (21) to estimate the $2^{nd}$ derivation of the function is commonly known in the art as the Muller's method.

Initial Global Gain Estimation

In one embodiment of the present invention, more than one global_gain values are stored in memory for the estimation of the initial Newton search conditions. In one embodiment, $gg_0$ is computed according to equation (11) and $gg_1$ is computed according to the following equation:

$$gg_1^m = \max\left\{gg_0^m + \beta,\ c_0 + \sum_k c_k \cdot \text{global_gain}^k,\ k = m-1, m-2, \ldots, m-N\right\} \tag{22}$$

where m corresponds to the current audio frame under iteration and $c_k$ are empirically determined coefficients. The coefficients $c_k$ could be determined by executing a regression of global_gain in audio frame m against the global_gain values from the previous N frames. Any other error minimization technique could also be used to estimate the global_gain coefficients.

The invention has been described in conjunction with the preferred embodiment. It is evident that numerous alternatives, modifications, variations and uses will be apparent to those skilled in the art in light of the foregoing description.

The invention claimed is:

1. A method comprising:

receiving audio samples representing an input audio signal;

transforming the input audio samples into a vector of spectral values in a frequency domain; and determining a value of a quantizing parameter, including: determining the value of the quantizing parameter, such that a maximum quantized value does not exceed a maximum index of one or more corresponding codebooks; and determining the value of the quantizing parameter based on a modified Newtonian search process, the determined value of the quantizing parameter being used to quantize the respective vector of spectral values to generate a vector of quantized values such that a total number of bits used for encoding the vector of quantized values does not exceed a maximum number of bits available for encoding the vector of the quantized values.

2. The method of claim 1 wherein the one or more codebooks are Huffman code tables.

3. The method of claim 1 wherein the value of the quantizing parameter is determined according to the following formula:

$$\text{global_gain} \geq \left\lceil A \cdot \log_2\left(\frac{\text{MAX}|x_r(i)|}{[B-C]^D}\right)\right\rceil$$

wherein global_gain corresponds to the value of the quantizing parameter, A corresponds to a first constant, xr(i) corresponds to an original spectral value for frequency line i, B corresponds to a second constant representing a maximum quantized spectral value, C corresponds to a third constant, and D corresponds to a fourth constant.

4. The method of claim 1 including:

computing a first estimate and a second estimate for the quantizing parameter; and performing a set of operations iteratively until a predetermined number of iterations is reached, including:

deriving a new estimate for the quantizing parameter based on the previous estimates for the quantizing parameter.

5. The method of claim 4 wherein deriving the new estimate includes:

calculating a line tangent to a function representing the total number of bits used based on the previous estimates; and calculating the new estimate based on an intercept between the line tangent calculated and a line representing the maximum number of bits available.

6. The method of claim 4 wherein performing the set of operations further including:

determining whether the total number of bits based upon the new estimate exceeds the maximum number of bits available;

if the total number of bits based upon the new estimate exceeds the maximum number of bits available, increasing the new estimate by a first factor; and if the total number of bits based upon the new estimate does not exceed the maximum number of bits available, decreasing the new estimate by a second factor.

7. The method of claim 6 wherein the first factor and second factor are integer values.

8. The method of claim 4 wherein the value of the quantizing parameter determined with respect to one block of spectral values is stored in memory and used as an initial estimate for a next block of spectral values.

9. An apparatus comprising:

logic to receive input audio samples representing corresponding input audio signals;

logic to transform the input audio samples into a vector of spectral values in a frequency domain; and logic to determine a value of a quantizing parameter, including:

logic to determine the value of the quantizing parameter such that a maximum quantized value does not exceed a maximum index of one or more corresponding codebooks; and logic to determine the value of the quantizing parameter based on a modified Newtonian search process, the determined value of the quantizing parameter being used to quantize the respective vector of spectral values to generate a vector of quantized values such that a total number of bits used for encoding the vector of quantized values does not exceed a maximum number of bits available for encoding the vector of the quantized values.

10. The apparatus of claim 9 wherein the value of the quantizing parameter is determined according to the following formula:

$$\text{global_gain} \geq \left\lceil A \cdot \log_2\left(\frac{\text{MAX}|x_r(i)|}{[B-C]^D}\right)\right\rceil$$

wherein global_gain corresponds to the value of the quantizing parameter, A corresponds to a first constant, xr(i) corresponds to an original spectral value for frequency line i, B corresponds to a second constant representing a maximum quantized spectral value, C corresponds to a third constant, and D corresponds to a fourth constant.

11. The apparatus of claim 9 including:

logic to compute a first estimate and a second estimate for the quantizing parameter; and logic to perform a set of operations iteratively until a predetermined number of iterations is reached, including:

logic to derive a new estimate for the quantizing parameter based on the previous estimates for the quantizing parameter.

12. The apparatus of claim 11 wherein logic to derive the new estimate including:

logic to calculate a line tangent to a function representing the total number of bits used based on the previous estimates; and logic to calculate the new estimate based on an intercept between the line tangent calculated and a line representing the maximum number of bits available.

13. The apparatus of claim 12 wherein logic to perform the set of operations further including:

logic to determine whether the total number of bits based upon the new estimate exceeds the maximum number of bits available;

logic to increase the new estimate by a first integer if the total number of bits based upon the new estimate exceeds the maximum number of bits available; and logic to decrease the new estimate by a second integer if the total number of bits based upon the new estimate does not exceed the maximum number of bits available.

14. A system comprising:

a transformation unit to transform input audio samples representing corresponding audio signals into a vector of spectral values in a frequency domain;

a psychoacoustic modeling unit to analyze the input audio samples and generate a frequency mask; and a bit allocator and quantizer unit coupled to the transformation unit and the psychoacoustic unit, the bit allocator and quantizer unit including:

logic to determine a value of a quantizing parameter, including:

logic to determine the value of the quantizing parameter such that a maximum quantized value does not exceed a maximum index of one or more corresponding codebooks; and logic to determine the value of the quantizing parameter based on a modified Newtonian search process, the determined value of the quantizing parameter being used to quantize the respective vector of spectral values to generate a vector of quantized values such that a total number of bits used for encoding the vector of quantized values does not exceed a maximum number of bits available for encoding the vector of the quantized values.

15. The system of claim 14 wherein logic to determine the value of the quantizing parameter includes:

logic to compute the value of the quantizing parameter such that a maximum quantized value does not exceed a maximum index of one or more corresponding codebooks, based upon the following formula:

$$\text{global_gain} \geq \left\lceil A \cdot \log_2\left(\frac{\text{MAX}|x_r(i)|}{[B-C]^D}\right)\right\rceil$$

wherein global_gain corresponds to the value of the quantizing parameter, A corresponds to a first constant, xr(i) corresponds to an original spectral value for frequency line i, B corresponds to a second constant representing a maximum quantized spectral value, C corresponds to a third constant, and D corresponds to a fourth constant.

16. The system of claim 14 including:

logic to compute a first estimate and a second estimate for the quantizing parameter; and logic to perform a set of operations iteratively until a predetermined number of iterations is reached, including:

logic to derive a new estimate for the quantizing parameter based on the previous estimates for the quantizing parameter.

17. The system of claim 16 wherein logic to derive the new estimate including:

logic to calculate a line tangent to a function representing the total number of bits used based on the previous estimates; and logic to calculate the new estimate based on an intercept between the line tangent calculated and a line representing the maximum number of bits available.

18. The system of claim 17 wherein logic to perform the set of operations further including:

logic to determine whether the total number of bits based upon the new estimate exceeds the maximum number of bits available;

logic to increase the new estimate by a first integer if the total number of bits based upon the new estimate exceeds the maximum number of bits available; and logic to decrease the new estimate by a second integer if the total number of bits based upon the new estimate does not exceed the maximum number of bits available.

19. A machine-readable medium comprising instructions which, when executed by a machine, cause the machine to perform operations including:

receiving audio samples representing an input audio signal;

transforming the input audio samples into a vector of spectral values in a frequency domain; and determining a value of a quantizing parameter, including: determining the value of the quantizing parameter such that a maximum quantized value does not exceed a maximum index of one or more corresponding codebooks; and determining the value of the quantizing parameter based on a modified Newtonian search process, the determined value of the quantizing parameter being used to quantize the respective vector of spectral values to generate a vector of quantized values such that a total number of bits used for encoding the vector of quantized values does not exceed a maximum number of bits available for encoding the vector of the quantized values.

20. The machine-readable medium of claim 19 wherein determining the value of the quantizing parameter includes:

determining the value of the quantizing parameter such that a maximum quantized value does not exceed a maximum index of one or more corresponding codebooks according to the following formula:

$$\text{global_gain} \geq \left\lceil A \cdot \log_2\left(\frac{\text{MAX}|x_r(i)|}{[B-C]^D}\right)\right\rceil$$

wherein global_gain corresponds to the value of the quantizing parameter, A corresponds to a first constant, xr(i) corresponds to an original spectral value for frequency line i, B corresponds to a second constant representing a maximum quantized spectral value, C corresponds to a third constant, and D corresponds to a fourth constant.

21. The machine-readable medium of claim 19 including:

computing a first estimate and a second estimate for the quantizing parameter; and performing a set of operations iteratively until a predetermined number of iterations is reached, including:

deriving a new estimate for the quantizing parameter based on the previous estimates for the quantizing parameter.

22. The machine-readable medium of claim 21 wherein deriving the new estimate includes:

calculating a line tangent to a function representing the total number of bits used based on the previous estimates; and calculating the new estimate based on an intercept between the line tangent calculated and a line representing the maximum number of bits available.

23. The machine-readable medium of claim 22 wherein performing the set of operations further including:

determining whether the total number of bits based upon the new estimate exceeds the maximum number of bits available;

if the total number of bits based upon the new estimate exceeds the maximum number of bits available, increasing the new estimate by a first factor; and if the total number of bits based upon the new estimate does not exceed the maximum number of bits available, decreasing the new estimate by a second factor.

* * * * *